United States Patent [19]

Erickson et al.

[11] 4,082,482

[45] Apr. 4, 1978

[54] ARTICULATED TURBINE PUMP

[75] Inventors: John W. Erickson, Huntington Beach; Harold L. Petrie, Pasadena, both of Calif.

[73] Assignee: Kobe, Inc., Huntington Park, Calif.

[21] Appl. No.: 761,367

[22] Filed: Jan. 21, 1977

[51] Int. Cl.[2] ..... F04B 47/14

[52] U.S. Cl. ..... 417/408; 417/424; 415/501

[58] Field of Search ..... 417/405, 408, 424, 358, 417/360; 415/501

[56] References Cited

U.S. PATENT DOCUMENTS

| | | | |
|---|---|---|---|
| 1,693,102 | 11/1928 | Worthington | 417/408 |
| 1,894,393 | 1/1933 | Bigelow | 415/501 |
| 2,113,213 | 4/1938 | Leonard | 417/408 |
| 2,706,451 | 4/1955 | Ortiz et al. | 415/501 |
| 3,758,238 | 9/1973 | Erickson et al. | 417/408 |
| 3,847,512 | 11/1974 | Brown et al. | 417/408 |
| 3,981,626 | 9/1976 | Onal | 417/405 |
| 4,003,678 | 1/1977 | David | 417/408 |

FOREIGN PATENT DOCUMENTS

| | | | |
|---|---|---|---|
| 971,401 | 9/1964 | United Kingdom | 415/501 |

*Primary Examiner*—C. J. Husar

*Attorney, Agent, or Firm*—Christie, Parker & Hale

[57] ABSTRACT

An articulated, submersible turbine pump for installation in a vertically elongated bottom hole assembly of a well has a flexible shaft and a plurality of rotor elements and stator elements mounted about the shaft in adjacent alternating relationship. Each rotor element has rotatable blades attached to the shaft by a hub and a housing segment surrounding the rotatable blades in outwardly spaced relationship therefrom to provide clearance for rotation. Each stator element has a close fitting hub around the shaft, which serves as a journal bearing, a housing segment outwardly spaced from the hub, and stationary blades attached between the hub and the housing segment. The housing segments are longer than the blades and the hub. Matching conical surfaces are formed at opposite ends of the housing segments to seal adjacent housing segments when axially aligned. An annular relief on the periphery of one of the surfaces permits the housing segments to pivot out of axial alignment when the shaft bends. Axial rotation between the housing segments is prevented by a key and a recess at opposite ends of each housing segment; the key of one segment fits loosely into the recess of the adjacent segment.

37 Claims, 8 Drawing Figures

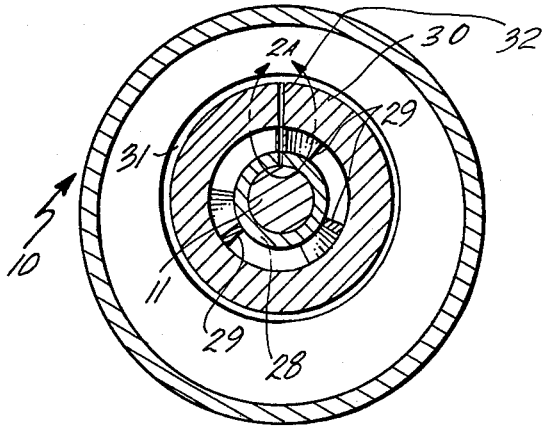
Fig. 2
Fig. 2A
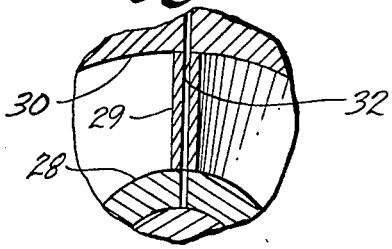
Fig. 5
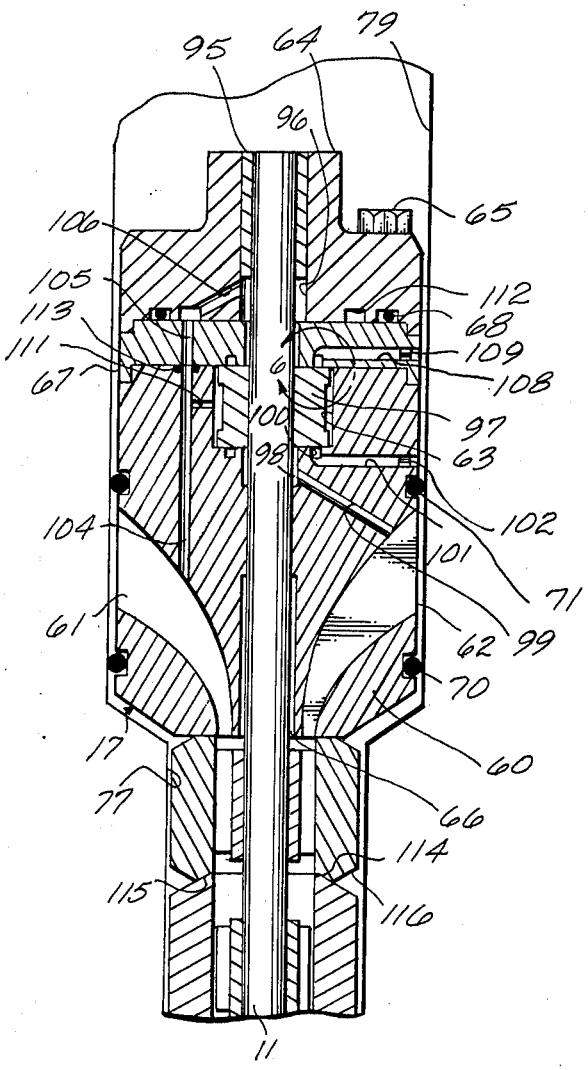
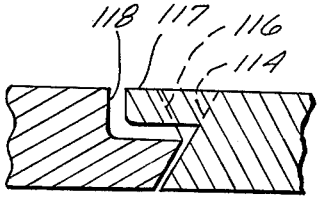
Fig. 3
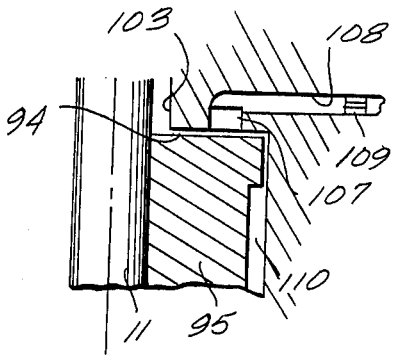
Fig. 6

ARTICULATED TURBINE PUMP

BACKGROUND OF THE INVENTION

This invention relates to fluid machinery, and more particularly to an articulated, submersible turbine pump suitable for installation in a bottom hole assembly of an underwater well.

Submersible turbine pumps for the purpose of bringing production fluid, such as oil and gas, from the bottom of a well to the earth's surface are described in the prior art. Since such a turbine pump must have a small diameter to pass through the flow line to the bottom of the well, an axial flow design is commonly used. Typically, an axial flow turbine and an axial flow pump interconnected in an end-to-end relationship are packaged in an elongated housing for installation in a bottom hole assembly of a well as a free turbine pump. Power fluid under very high pressure is transmitted down the flow line to the turbine pump installed in the bottom hole assembly to power the turbine, which in turn drives the pump.

An underwater gas and/or oil well commonly has a 270 degree loop at the top of the flow line to change the direction of flow from vertical to horizontal. Presently known turbine pumps are straight, rigid, elongated structures not capable of readily passing through a curved pipe such as that at the top of the flow line in an underwater well.

SUMMARY OF THE INVENTION

The invention concerns articulated fluid machinery that can be bent to pass through a curved pipe such as that at the top of an underwater flow line and can be put into operation when straight. The machinery comprises a flexible shaft and a plurality of rotor elements and stator elements mounted about the shaft in adjacent alternating relationship. Each rotor element has one or more rotatable blades attached to the shaft and a housing segment surrounding the one or more rotatable blades and spaced outwardly therefrom to provide clearance for rotation of the one or more rotatable blades. Each stator element has one or more stationary blades spaced outwardly from the shaft and a housing segment surrounding and attached to the one or more stationary blades. The interface between adjacent housing segments is sealed when axially aligned, but permits the housing segments to pivot out of axial alignment when the shaft bends. The housing segments of at least one type of element, i.e., rotor and/or stator are longer than the one or more blades surrounded by such housing segments in order to avoid interference with segment pivoting when the shaft bends. Axial rotation between the housing segments is prevented. Journal and thrust bearings are provided.

The preferred embodiment of the articulated fluid machinery has an axial flow design. Each stator element has a hub that fits closely around the shaft to serve as a journal bearing; the one or more stationary blades are attached between the hub and the housing segment. Each rotor element has a hub by which the one or more rotatable blades are attached to the shaft. Matching conical surfaces at opposite ends of each housing segment seal adjacent housing segments when seated in axial alignment. An annular relief at the periphery of one of the conical surfaces permits the housing segments to pivot out of axial alignment when the shaft bends. Axial rotation is prevented by a key and a recess at opposite ends of each housing segment; the key of one housing segment fits loosely into the recess of the adjacent segment so as to avoid interference with segment pivoting when the shaft bends.

BRIEF DESCRIPTION OF THE DRAWINGS

The features of a specific embodiment of the best mode contemplated of carrying out the invention are illustrated in the drawings in which:

FIG. 2 is a sectional view of one of the stator elements of the turbine pump taken through the plane indicated by 2—2 in FIG. 1A, and FIG. 2A is an enlargement of part of FIG. 2;

FIG. 3 is a sectional view of adjacent rotor and stator elements of the turbine pump taken through the plane indicated by 3—3 in FIG. 1A;

FIG. 5 is a side sectional view of the power fluid outlet element of the turbine pump of FIGS. 1A and 1B illustrating the position of the shaft and its thrust bearing when the turbine pump is installed in the bottom hole assembly; and FIG. 6 is an enlargement of a portion of FIG. 5 illustrating the details of the thrust bearing.

DETAILED DESCRIPTION OF THE SPECIFIC EMBODIMENT

Figure 1A:
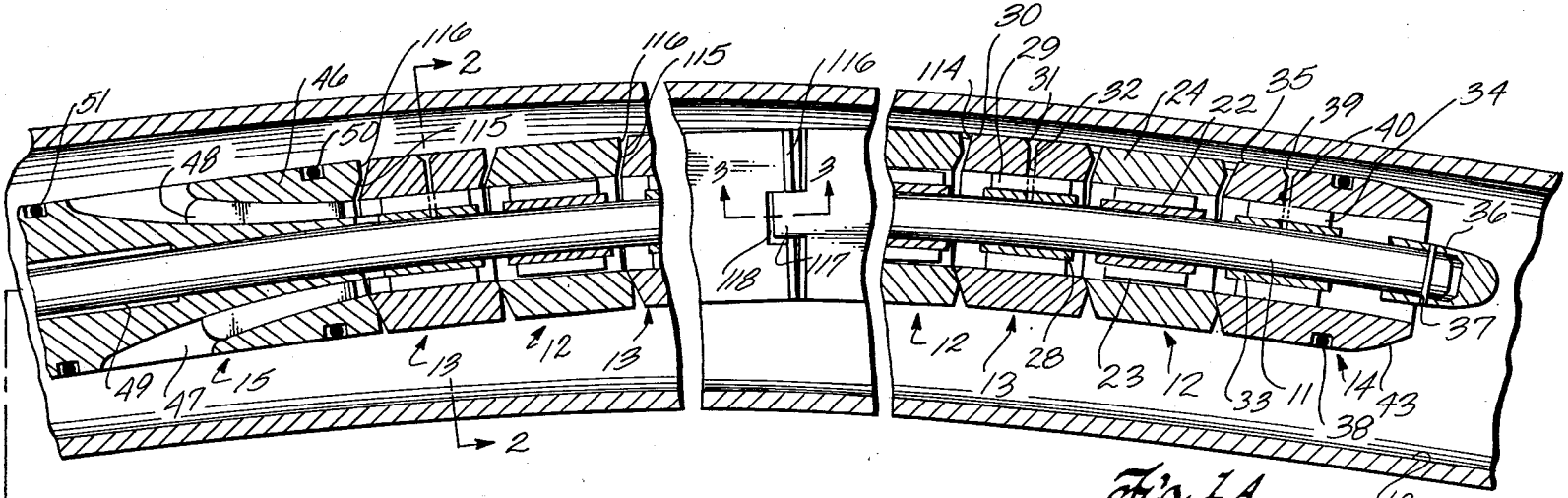
FIGS. 1A and 1B taken together are a side sectional view of an articulated axial flow turbine pump in a bent condition inside a curved pipe such as a loop at the top of a flow line.
Figure 1B:
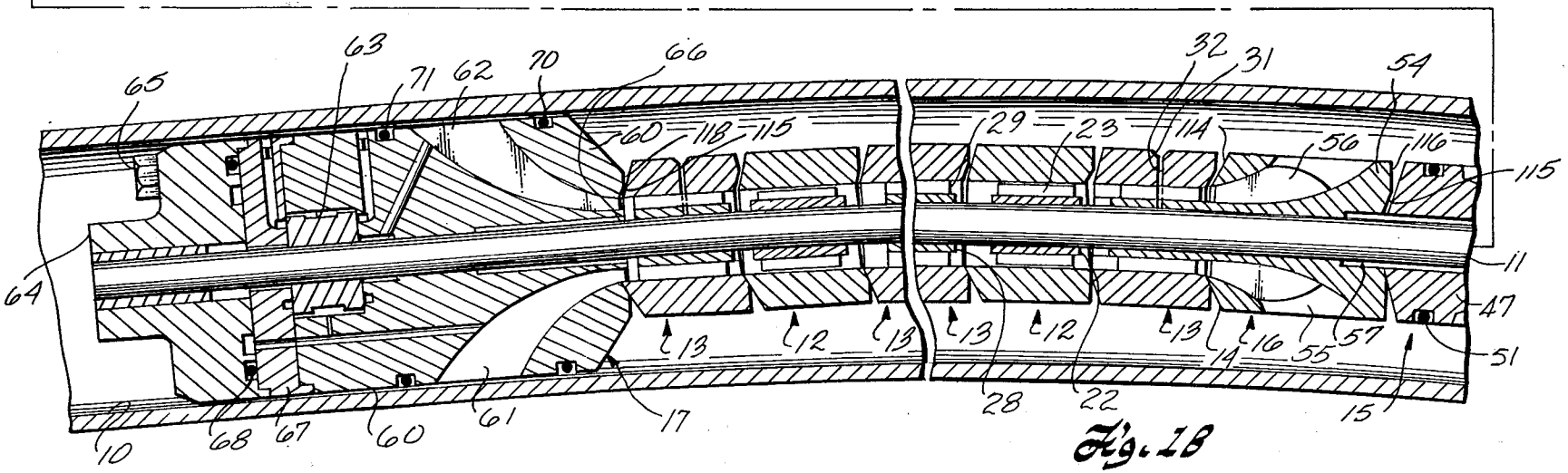

In FIGS. 1A and 1B an articulated fluid machine is shown in a bent state inside a curved pipe 10, such as a loop at the top of a flow line of an underwater oil and/or gas well. In a typical embodiment, pipe 10 would have a radius of 5 feet and an inside diameter of 2 inches. The fluid machine comprises a long, thin, flexible, i.e., bendable, shaft 11 formed from a single piece of metal about which a plurality of identical rotor elements 12 and a plurality of identical stator elements 13 are mounted in adjacent, alternating relationship. In a typical embodiment, shaft 11 is 5 feet long and $\frac{3}{8}$ inch in diameter, and rotor elements 12 and stator elements 13 are each $1\frac{3}{8}$ inches in diameter and 1 inch in length. An inlet element 14 for production fluid is mounted about the bottom of shaft 11, and an outlet element 15 for production fluid is mounted about the middle of shaft 11. Rotor elements 12 and stator elements 13 between production fluid inlet element 14 and production fluid outlet element 15 comprise an axial flow pump. An inlet element for power fluid is mounted about the middle of shaft 11 adjacent to production fluid outlet element 15, and an outlet element 17 for power fluid is mounted about the top of shaft 11. Rotor elements 12 and stator elements 13 between power fluid inlet element 16 and power fluid outlet element 17 comprise an axial flow turbine that drives the axial flow pump responsive to power fluid.

Rotor elements 12 each comprise a hub 22 attached directly to shaft 11, one or more, preferably three, rotatable blades 23 attached directly to hub 22, and a rotor housing segment 24 surrounding rotatable blades 23 in outwardly spaced relationship therefrom to provide clearance for rotation of rotatable blades 23.

Stator elements 13 each comprise a hub 28 that fits closely around the shaft 11 to serve as a journal bearing therefor, one or more, preferably three, stationary blades 29 attached directly to hub 28, and a stator housing segment 30 surrounding and attached directly to stationary blades 29. As illustrated in FIG. 2, an annular groove 31 girds the periphery of stator housing segment 30. A lubricating passage 32 extends radially from groove 31 through stator housing segment 30, one of blades 29, and hub 28 to the surface of shaft 11 for the purpose of lubricating the journal bearing.

The annular space between rotor housing segments 24 and hubs 22 and the annular space between stator housing segments 30 and hubs 28 comprise connecting passages for fluid flow axially along shaft 11 through rotor and stator elements 12 and 13 from each inlet element 14, 16 to each outlet element 15, 17. Rotatable blades 23 are oriented to intercept fluid flowing through the connecting passages. Stationary blades 29 are oriented to direct fluid flowing through the connecting passages toward rotatable blades 23. The shape and orientation of rotatable and stationary blades 23 and 29 are designed in accordance with well known principles to direct fluid flow axially of shaft 11 and to maximize energy transfer between the fluid and the blades for such axial flow operation.

Production fluid inlet element 14 (FIG. 1A) includes a hub 33 that fits closely around the lower end of shaft 11 to serve as a journal bearing therefor, one or more, preferably three, stationary blades 34 attached to hub 33, and a housing segment 35 surrounding and attached to stationary blades 34. An annular groove 39 girds the periphery of housing segment 35 and a lubricating passage 40 extends radially from groove 39 through housing segment 35, one of blades 34 and hub 33, to the surface of shaft 11 for the purpose of lubricating the journal bearing. An end cap 36 is secured to the bottom of shaft 11 by a pin 37 to retain inlet element 14 on shaft 11 when the fluid machine is not seated in a bottom hole assembly. An O-ring 38 is retained in an annular groove formed in housing segment 35. End cap 36 has a downwardly facing streamlined nose, and housing segment 35 has a downwardly open bore that collectively define the inlet of the turbine pump for production fluid. The lower end of housing segment 35 also has a tapered outer surface 43 designed to seat in the bottom hole assembly.

Production fluid outlet element 15 (FIG. 1A) comprises a housing segment 46 that surrounds shaft 11, a diverging outlet passage 47 through housing segment 46, and one or more, preferably three, stationary blades 48 disposed in outlet passage 47. The lower portion of housing segment 46 fits closely around shaft 11 to serve as a journal bearing, and the upper portion of housing segment 46 is spaced outwardly from shaft 11 to form an annular passage 49. O-rings 50 and 51 are retained in annular grooves formed in housing segment 46 on opposite sides of outlet passage 47.

Power fluid inlet element 16 (FIG. 1B) comprises a housing segment 54 that surrounds shaft 11, a converging inlet passage 55 though housing segment 54, and one or more, preferably three, stationary blades 56 disposed in inlet passage 55. The upper portion of housing segment 54 fits closely around shaft 11 to serve as a journal bearing, and the lower portion of housing segment 54 is spaced outwardly from shaft 11 to form an annular passage 57.

Power fluid outlet element 17 (FIG. 1B) comprises a housing segment 60 that surrounds shaft 11, a diverging outlet passage 61 though housing segment 60, and one or more, preferably three, stationary blades 62 disposed in outlet passage 61. The outer diameter of housing segment 60, which is substantially larger than the diameter of the remainder of the machine, is sized to pass through curved pipe 10 with a small clearance. Housing segment 60 has an upper portion that fits closely around shaft 11 to serve as a journal bearing, and a lower portion that is spaced outwardly from shaft 11 to form an annular passage 66. Housing segment 60 has a cylindrical cavity 63 which houses a thrust bearing described below in connection with FIGS. 5 and 6. An upper end cap 64 and a passage-containing disc 67 are attached to the end of housing segment 60 by one or more fasteners 65 to cover cavity 63. An O-ring 68 retained in an annular groove formed around the surface of end cap 64 adjacent to disc 67, seals the interface between end cap 64 and disc 67. Centering rings on the peripheries of end cap 64 and disc 67 serve to align them axially with housing segment 60. O-rings 70 and 71 are retained in annular grooves formed in housing segment 60 on opposite sides of outlet passage 61.

Figure 4:
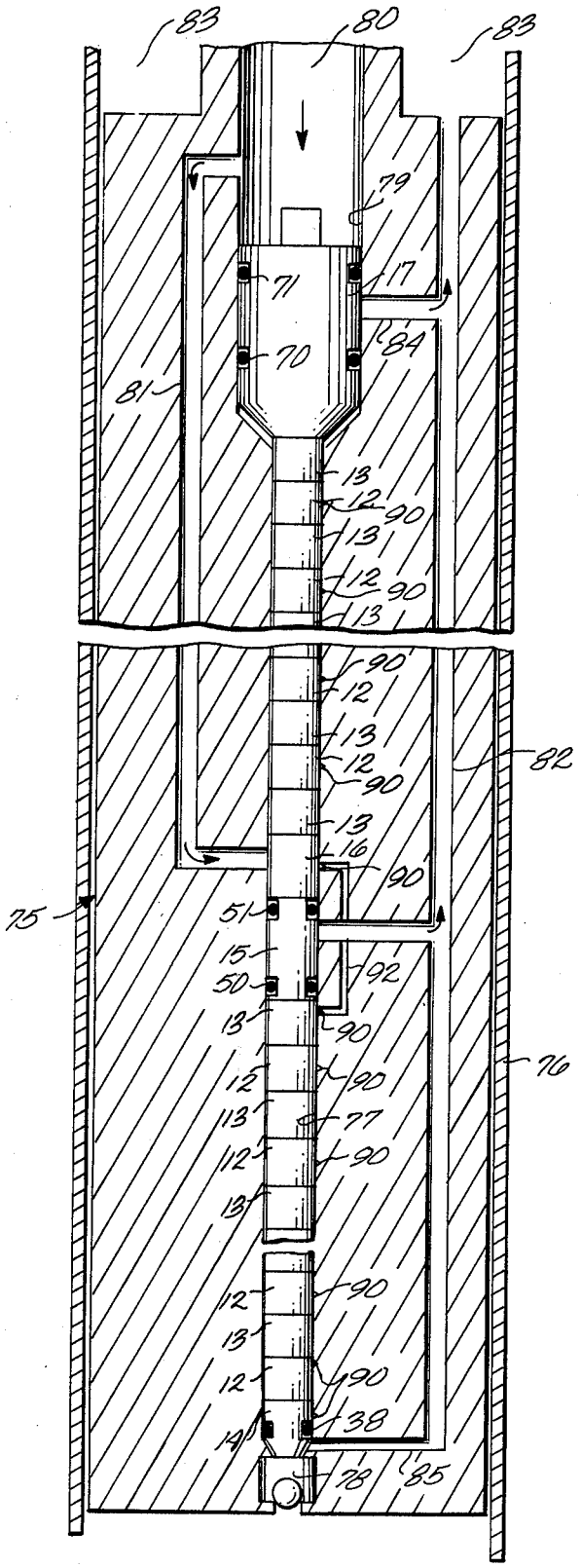
FIG. 4 is a schematic diagram of a bottom hole assembly in which the turbine pump of FIGS. 1A and 1B is installed.

In FIG. 4, a bottom hole assembly 75 is disposed at the bottom of a well casing 76. Bottom hole assembly 75 has a narrow, straight, vertically elongated cylindrical chamber 77 into which the articulated fluid machine shown in FIGS. 1A and 1B fits as a free submersible turbine pump. Elements 12, 13, 14, 15, and 16 fit snugly in narrow chamber 77 in axial alignment. Surface 43 (FIG. 1A) of production fluid inlet element 14 seats on a standing valve 78, which connects the bottom of narrow chamber 77 to the bottom of well casing 76. Power fluid outlet element 17 fits snugly in an enlarged cylindrical chamber 79, which connects the top of narrow chamber 77 to a pressurized power fluid line 80. Well casing 76 and pressurized power fluid line 80 extend up to the well-head. A pressurized power fluid conduit 81 is formed in bottom hole assembly 75 between enlarged chamber 79 and the inlet of power fluid inlet element 16. A production fluid conduit 82 is formed in bottom hole assembly 75 between the outlet of production fluid outlet element 15 and an annular production fluid line 83 defined by the walls of power fluid line 80 and well casing 76. O-rings 50 and 51 seal the coupling between production fluid outlet element 15 and production fluid conduit 82 from pressurized power fluid. A spent power fluid conduit 84 is formed in bottom hole assembly 75 to connect the outlet of power fluid outlet element 17 to production fluid conduit 82. A trapped fluid conduit 85 is formed in bottom hole assembly 75 to connect the bottom of narrow chamber 77 to production fluid conduit 82. O-rings 70 and 71 seal the coupling between power fluid outlet element 17 and spent power fluid conduit 84 from pressurized power fluid.

A spiral groove 90 is formed around the surface of narrow chamber 77 from top to bottom. To facilitate illustration, spiral groove 90 is greatly enlarged in FIG. 4. Spiral groove 90 starts below enlarged chamber 79, extends downwardly through narrow chamber 77 with an interruption where production fluid outlet element 15 is located, and terminates near the bottom of narrow chamber 77 above standing valve 78. As a result, spiral groove 90 intersects groove 31 of stator elements 13 to communicate with lubricating passage 32 therein and intersects groove 39 of production fluid inlet element 14 to communicate with lubricating passage 40 therein. A lubricant coupling conduit 92 is formed in bottom hole assembly 75 to connect spiral groove 90 where power fluid inlet element 16 is located with spiral groove 90 where the stator element 13 directly below production fluid outlet element 15 is located. Lubricant coupling conduit 92 provides continuity of lubricating oil supply at the interruption of spiral groove 90, which is formed for the purpose of preventing leakage of lubricating oil to production fluid conduit 82. Thus, O-rings 50 and 51 also seal the coupling from the production fluid outlet to production fluid conduit 82 from spiral groove 90, thereby preventing loss of lubricating oil pressure. Similarly, O-ring 38 seals the standing valve 78 and conduit 85 from spiral groove 90. Power fluid conduit 81 communicates with spiral groove 90 at power fluid inlet element 16 to supply lubricant upwardly through spiral groove 90 and downwardly through lubricant coupling conduit 92 to the journal bearings of the machine.

Reference is made to FIGS. 5 and 6 for a detailed description of the thrust bearing in power fluid outlet element 17. A cylindrical dummy thrust collar 95 is attached to the upper end of shaft 11. End cap 64 has a bore 96 dimensioned for a close fit with dummy thrust collar 95. Dummy thrust collar 95 and the end of shaft 11 extend into bore 96 of end cap 64, and the pressure of the power fluid in chamber 79 is exerted thereon. Bore 96 serves as a journal bearing in end cap 64 for the end of shaft 11. A cylindrical main thrust collar 97 is attached to shaft 11 within cavity 63. There are small clearances, e.g., 5 mils, between the ends of main thrust collar 97 and the ends of cavity 63. The clearance at the upper end of cavity 63 is designated 94 in FIG. 6. As shaft 11 moves axially up and down slightly, the clearances increase and decrease in complementary fashion, i.e., one clearance becomes smaller and the other larger. Thus, the clearances form restrictions having a variable cross section. An annular passage 98 is formed in housing segment 60 around shaft 11 adjacent to the lower end of cavity 63. A conduit 99 extends through housing segment 60 from the power fluid outlet to annular passage 98. An annular groove 100 is formed in housing segment 60 adjacent to and in communication with the lower end of cavity 63. A radial passage 101 extends through housing segment 60 from its periphery to annular groove 100. A restriction 102 having a fixed cross section is formed in radial passage 101. An annular passage 103 is formed in disc 67 around shaft 11 adjacent to the top of cavity 63. Annular passage 103 communicates directly with bore 96. Interconnecting passages 104, 105, and 106 extend through housing segment 60, disc 67, and end cap 64, respectively, from the power fluid outlet to bore 96. An annular groove 112 is formed at the surface of end cap 64 adjacent to disc 67 to interconnect passages 105 and 106. An O-ring 113 seals the junction between passages 104 and 105. An annular groove 107 is formed in disc 67 adjacent to and in communication with the upper end of cavity 63. A radial passage 108 extends through disc 67 from its periphery to annular groove 107. A restriction 109 having a fixed cross section is formed in radial passage 108. An annular groove 110 is formed around the side of main thrust collar 97. A radial passage 111 extends through housing segment 60 from annular groove 110 to passage 104. The fluid in annular passages 98 and 103 and annular groove 110 is approximately at the pressure of the exhaust power fluid at the power fluid outlet.

When the fluid machine is operating in place in bottom hole assembly 75, a net upward thrust is exerted on shaft 11 by the turbine pump. The pressure of the power fluid in chamber 79 is exerted on the upper end surfaces of shaft 11 and dummy thrust collar 95. The pressure of the spent power fluid in the power fluid outlet is exerted on the lower end surface of dummy thrust collar 95. Dummy thrust collar 95 is dimensioned so the net force resulting from these pressures approximately offsets the upward thrust on shaft 11 exerted by the turbine pump. Variations of the resultant axial force exerted on shaft 11 by the turbine pump in either direction are offset by main thrust collar 97 as follows. Restriction 109 and the clearance at the top of cavity 63 form in effect two orifices in the fluid circuit from chamber 79 through radial passage 108 and annular groove 107 to annular passage 103 and annular groove 110. As the upward thrust exerted on shaft 11 by the turbine pump decreases, the clearance at the top of cavity 63 becomes larger and the pressure in annular groove 107 drops, approaching that of the spent power fluid; thus, main thrust collar 97 is urged back in an upward direction. As the upward thrust exerted on shaft 11 by the turbine pump increases, the clearance at the top of cavity 63 becomes smaller and the pressure in annular groove 107 rises toward that of the pressurized power fluid in chamber 79; thus, main thrust collar 97 is urged back in a downward direction. Similarly, restriction 102 and the clearance at the bottom of cavity 63 form in effect two orifices in the fluid circuit from chamber 79 through radial passage 101 and annular groove 100 to annular passage 98 and annular groove 110. This fluid circuit operates in a fashion complementary to the fluid circuit exerting the force on the top of main thrust collar 97. In summary, the two fluid circuits function in push-pull relationship to balance the forces exerted on shaft 11; the pressure in each groove changes in inverse relationship to the corresponding clearance.

At its upper end, each of housing segments 24, 30, 35, 46, and 54 has a flat conical surface 114. At its lower end, each of housing segments 24, 30, 46, 54, and 60 has a flat conical surface 115 that matches conical surface 114 and a flat annular relief 116 formed by cutting away part of the periphery of surface 115. When housing segments 24, 30, 35, 46, 54, and 60 are compressed together in axial alignment, conical surfaces 114 and 115 of adjacent segments seat on each other to establish a metal-to-metal seal between such adjacent segments. Relief 116 of each housing segment permits adjacent housing segments to unseat and pivot out of axial alignment when housing segments 24, 30, 35, 46, 54, and 60 are not compressed together.

At the outer surface of the upper end of each of housing segments 24, 30, 35, 46, and 54, a key 117 is formed. At the outer surface of the lower end of each of housing segments 24, 30, 46, 54, and 60, a key receiving recess 118 is formed to receive key 117 of the adjacent housing segment. As illustrated in FIGS. 1A and 3, each key 117 fits loosely into key receiving recess 118 of the adjacent housing segment so as to avoid interference with the pivoting of the housing segments out of axial alignment. Keys 117 and key receiving recesses 118 serve to prevent axial rotation between housing segments 24, 30, 35, 46, 54, and 60, and to form for the entire fluid machine in effect a single integral housing that is bendable in the absence of axial compression. Rotor housing segments 24 are longer than hubs 22 and rotatable blades 23, which are attached to shaft 11 so their ends are equally spaced from the ends of rotor housing segments 24. Stator housing segments 30 are longer than hubs 28 and stationary blades 29. Thus, shaft 11 is free to bend between adjacent hubs and the hubs and blades of adjacent elements to not interfere with pivoting of the housing segments out of axial alignment, when shaft 11 is bent.

As illustrated in FIGS. 1A and 1B, when the fluid machine passes through curved pipe 10, the portions of shaft 11 between hubs 22 and 28 and the portions of shaft 11 at annular passages 49, 57, and 66 bend accordingly within the elastic limit of shaft 11. Housing segments 24, 30, 35, 46, 54, and 60 pivot out of axial alignment with each other to conform to the curvature of shaft 11. As shaft 11 bends and the housing segments pivot out of axial alignment, shaft 11 shifts axially with respect to the housing segments. In effect, the curvature of the machine increases the overall length of the bearing structure of elements 12 through 17, in which shaft 11 lies. In rotor elements 12, the axial shift takes place in the clearance between housing segments 24 and rotatable blades 23. In stator elements 13, the axial shift takes place in the journal bearing between shaft 11 and hubs 28. The upper end of shaft 11 is in essence axially fixed with respect to housing segment 60 by virtue of the small clearance between main thrust collar 97 and the ends of cavity 63. Therefore, the axial shift of shaft 11 with respect to the housing segments is cumulative from the top of shaft 11 down, i.e., the shift is smallest at the top, largest at the bottom, and increases gradually therebetween.

Preferably, the housing segments themselves and the allowable axial shift of shaft 11 with respect to the housing segments are designed so the housing as a unit has as large a limit of bendability as shaft 11; in other words, the housing segments are able to bend to conform to as much of a curvature as shaft 11 can bend to without exceeding its elastic limit. Thus, the ability of the fluid machine to conform to a curvature is only limited by the limit of elasticity or bendability of shaft 11.

To install the fluid machine shown in FIGS. 1A and 1B in bottom hole assembly 75, the fluid machine is placed in power fluid line 80 at the wellhead and run into place by pumping power fluid under pressure into power fluid line 80 above the fluid machine. The fluid machine thus passes down through power fluid line 80 with the power fluid. The fluid trapped below the fluid machine in power fluid line 80 closes standing valve 78, and thus is displaced upwardly through trapped fluid conduit 85, spent power fluid conduit 84, and production fluid conduit 82 in bottom hole assembly 75 to production fluid line 83. When surface 43 of inlet element 14 seats on standing valve 78, the fluid machine comes to rest and is held in position by the pressure of the power fluid. A seal is established between housing segment 35 and standing valve 78 by the pressure of the power fluid in power fluid line 80. Power fluid outlet element 17 fits snugly into enlarged chamber 79 and the remainder of the fluid machine fits snugly into narrow chamber 77. In a typical embodiment, the power fluid is oil recovered from the well as production fluid with some of the gas, water, and sand removed and such power fluid is pressurized at the wellhead to between 3,000 and 5,000 psi by a triplex pump.

To remove the fluid machine from bottom hole assembly 75, the direction of flow of pressurized power fluid is reversed. Power fluid is pumped down production fluid line 83 to conduits 82, 84, and 85, thereby unseating housing segment 35 from standing valve 78 and lifting the fluid machine up power fluid line 80 to the wellhead with the reverse flowing power fluid.

When the fluid machine is in place, housing segments 24, 30, 35, 46, 54, and 60 are held in axial alignment by bottom hole assembly 75 and are compressed together by the pressure of the power fluid in power fluid line 80. Thus, conical surfaces 114 and 115 seal adjacent housing segments. The pressurized power fluid pumped down power fluid line 80 flows through pressurized power fluid conduit 81 to power fluid inlet element 16. As the power fluid flows through the axial flow turbine from power fluid inlet element 16 to power fluid outlet element 17, it transfers energy to rotatable blades 23, thereby rotating shaft 11 and driving rotatable blades 29 of rotor elements 12 in the axial flow pump between production fluid inlet element 14 and production fluid outlet element 15. The spent power fluid flows from power fluid outlet element 17 through spent power fluid conduit 84 and production fluid conduit 82 to production fluid line 83. Alternatively, if desired, a separate line could be provided for return of power fluid to the wellhead. Rotatable blades 29 of the pump open standing valve 78 and draw production fluid, typically oil and gas, through standing valve 78 to production fluid inlet element 14. As the production fluid flows through rotor and stator elements 12 and 13 between production fluid inlet element 14 and production fluid outlet element 15, rotatable blades 23 transfer energy to it. Production fluid flows through production fluid conduit 82 to production fluid line 83 for transmission to the wellhead. The production fluid leaves production fluid outlet element 15 at the column pressure, which is sufficiently high to transmit the production fluid to the wellhead. A typical column pressure for a well depth of 10,000 feet is 4,000 psi.

The placement of rotor elements 12 and stator elements 13 in adjacent alternating relationship about shaft 11 permits the journal bearings of stator elements 13 to support shaft 11 at closely spaced intervals all along its length. The journal bearings in stator elements 13 and the journal bearings in elements 14 through 17 thus maintain shaft 11 in precise axial alignment during operation. Yet the spacing between the journal bearings of stator elements 13 and annular passages 49, 57, and 66, which shorten the length of the journal bearings in elements 15, 16, and 17, respectively, permit shaft 11 to bend as the fluid machine passes through curved pipe 10.

The thrust bearing in power fluid outlet element 17 supports shaft 11 axially, accommodates the small axial shifts of shaft 11 that occur during operation of the fluid machine, and accommodates the axial shift of shaft 11 relative to the housing segments when shaft 11 bends during installation of the fluid machine.

The described embodiment of the invention is only considered to be preferred and illustrative of the inventive concept; the scope of the invention is not to be restricted to such embodiment. Various and numerous other arrangements may be devised by one skilled in the art without departing from the spirit and scope of this invention. For example, other means for sealing the interface between adjacent housing segments and other means for permitting adjacent housing segments to pivot out of axial alignment when the shaft bends could be employed. Although an axial flow design is preferable for a small diameter, the features of the invention could also be practiced in a centrifugal or mixed flow machine, in which case the rotor and stator blades would be redesigned accordingly, to most efficiently achieve such flow, and impellers including rotor blades would be employed instead of hubs. The features of the invention could also be practiced with a flexible shaft of other than a one piece construction, i.e., a shaft formed from a plurality of pivoted, rigid segments. Instead of the key and key receiving recess arrangement, other equivalent means could be employed to prevent axial rotation between the housing segments. Although the housing elements of both the rotor elements and stator elements are longer than the corresponding hubs, so the hubs do not interfere with pivoting of the housing segments out of axial alignment, this function could also be achieved by making the housing segments of only one of the elements, i.e., 12 or 13, longer than the corresponding hubs. 9n

What is claimed is:

1. Articulated fluid machinery comprising:

a flexible shaft;

a plurality of rotor elements and a plurality of stator elements mounted about the shaft in adjacent, alternating relationship, the elements having connecting passages for fluid flow generally along the shaft;

an inlet at one end of the elements for introduction of fluid flowing through the passages of the elements;

an outlet at the other end of the elements for removal of fluid flowing through the passages of the elements;

each rotor element having one or more rotatable blades attached to the shaft and oriented to intercept fluid flowing through its passage and a housing segment surrounding the one or more rotatable blades and spaced outwardly therefrom to provide clearance for rotation of the one or more rotatable blades;

each stator element having one or more stationary blades unattached to the shaft and oriented to direct fluid flowing through its passage toward the rotatable blades, and a housing segment surrounding and attached to the one or more stationary blades;

journal bearing means supporting the shaft for rotation within the housing segments;

thrust bearing means supporting the shaft axially within the housing segments and permitting the shaft to shift axially relative to the housing segments when the shaft bends;

interfacing means between adjacent housing segments for sealing such adjacent housing segments when axially aligned, the interfacing means permitting such adjacent housing segments to pivot out of axial alignment when the shaft bends; and means for preventing axial rotation between the housing segments.

2. The fluid machinery of claim 1, in which the housing segments of at least one type, i.e., rotor or stator, are longer than the one or more blades surrounded by such housing segments.

3. The fluid machinery of claim 2, in which the journal bearing means comprise a hub for each stator element surrounding the shaft in close fitting relationship and attached to the one or more stationary blades such that the one or more stationary blades extend radially from such hub to the housing segment of such stator element.

4. The fluid machinery of claim 3, additionally comprising a lubrication passage for each stator element extending radially through the corresponding housing segment, one of the stationary blades, and the hub to the surface of the shaft.

5. The fluid machinery of claim 4, in which each rotor element additionally has a hub surrounding and attached directly to the shaft; the one or more rotatable blades being attached directly to the hub and extending radially between the hub and the housing segment.

6. The fluid machinery of claim 5, in which the housing segments of both the rotor and stator elements are longer than the blades and hubs surrounded by such housing segments.

7. The fluid machinery of claim 6, in which the axial rotation preventing means comprises:

a recess and a key formed at opposite ends of the outer surface of each housing segment, the key of each housing segment fitting loosely into the recess of the adjacent housing segment to avoid interference with pivoting of the housing segments when the shaft bends.

8. The fluid machinery of claim 7, in which the interfacing means comprises:

matching conical surfaces at opposite ends of each housing segment, the conical surfaces of adjacent housing segments seating when axially aligned; and an annular relief on the periphery of at least one of the matching conical surfaces to permit the matching conical surfaces to unseat when the housing segments pivot out of axial alignment.

9. The fluid machinery of claim 8, in which the shaft is formed from a single piece of metal.

10. The fluid machinery of claim 9, in which the stationary blades and the rotatable blades are both shaped and oriented to direct fluid flow axially of the shaft.

11. The fluid machinery of claim 1, in which the shaft is formed from a single piece of metal.

12. The fluid machinery of claim 1, in which each rotor element additionally has a hub surrounding and attached to the shaft; the one or more rotatable blades being attached to the hub and extending radially between the hub and the housing segment.

13. The fluid machinery of claim 1, in which the axial rotation preventing means comprises:

a recess and a key formed at opposite ends of the outer surface of each housing segment, the key of each housing segment fitting loosely into the recess of the adjacent housing segment to avoid interference with pivoting of the housing segments when the shaft bends.

14. The fluid machinery of claim 1, in which the interfacing means comprises:

matching conical surfaces at opposite ends of each housing segment, the conical surfaces of adjacent housing segments seating when axially aligned; and an annular relief on the periphery of at least one of the matching conical surfaces to permit the matching conical surfaces to unseat when the housing segments pivot out of axial alignment.

15. The fluid machinery of claim 2, in which the housing segments of both the rotor and stator elements are longer than the blades surrounded by such housing segments.

16. The fluid machinery of claim 1, in which the stationary blades and the rotatable blades are both shaped and oriented to direct fluid flow axially of the shaft.

17. A submersible, turbine pump for installation in an elongated bottom hole assembly of a well, the turbine pump comprising:

a rotatable, bendable shaft;

a plurality of sets of one or more rotatable blades and a plurality of sets of one or more stationary blades mounted about the shaft in adjacent alternating relationship, the rotatable blades being attached to the shaft;

an elongated, stationary, bendable housing surrounding the shaft and the blades and adapted to fit in the bottom hole assembly, the housing having as large a limit of bendability as the shaft and the stationary blades being attached to the housing;

journal bearing means supporting the shaft for rotation within the housing;

thrust bearing means supporting the shaft axially within the housing;

an inlet at one end of a first portion of the sets of blades for introduction from the well of production fluid flowing through the first portion along the shaft;

an outlet at the other end of the first portion of the sets of blades for discharge of pressurized production fluid flowing through the first portion along the shaft;

an inlet at one end of a second portion of the sets of blades for introduction of pressurized power fluid flowing through the second portion along the shaft; and an outlet at the other end of the second portion of the sets of blades for discharge of spent power fluid flowing through the second portion along the shaft.

18. The turbine pump of claim 17, in which the housing is articulated.

19. The turbine pump of claim 18, in which the housing comprises a plurality of individual housing segments fixed relative to each other with respect to axial rotation, means for sealing the housing segments when axially aligned, and means for permitting the housing segments to pivot out of axial alignment when the shaft bends.

20. The turbine pump of claim 19, in which the sealing means comprises matching conical surfaces at opposite ends of each housing segment, the conical surfaces of adjacent housing segments seating when axially aligned.

21. The turbine pump of claim 20, in which the means for permitting the housing segments to pivot out of axial alignment comprises an annular relief on the periphery of only one of the matching conical surfaces of each housing segment to permit the matching conical surfaces to unseat when the housing segments pivot out of axial alignment.

22. The tubine pump of claim 19, in which one housing segment surrounds each set of blades.

23. The turbine pump of claim 17, in which the journal bearing means comprise a hub for each set of stationary blades surrounding the shaft in close fitting relationship and attached to such set of stationary blades.

24. The tubine pump of claim 23, additionally comprising a source of lubricant, a radial lubricating passage for each hub extending radially through the housing and one of the stationary blades corresponding to each hub to the surface of the shaft, and means for connecting the source to each lubricating passage at the housing to supply lubricant to the journal bearing.

25. The turbine pump of claim 17, in which the housing has a small diameter over the major portion of its length and an upper portion with an enlarged diameter, and the thrust bearing means is located within the upper portion of the housing.

26. The turbine pump of claim 17, in which the bottom hole assembly has a side wall adjacent to the housing and a spiral groove formed in the side wall over the length of the housing, the housing comprises a housing segment surrounding each set of blades, and the journal bearing means comprises a hub for each set of stationary blades surrounding the shaft in close fitting relationship, the turbine pump additionally comprising a lubrication passage extending radially through each housing segment surrounding a set of stationary blades, one of such set of stationary blades, and the corresponding hub to the surface of the shaft, and source of lubricant connected to the spiral groove.

27. The turbine pump of claim 17, in which the shaft is a single piece of material.

28. The turbine pump of claim 17, in which the housing has a small diameter over the major portion of its length and an enlarged uphole portion adapted to fit in the bottom hole assembly, the thrust bearing means being located within the enlarged uphole portion of the housing.

29. An axial flow turbine pump for installation in an elongated bottom hole assembly, the turbine pump comprising:

an axial flow turbine;

an axial flow pump;

a rotatable shaft coupling the turbine to the pump;

an elongated stationary housing having a small diameter over the major portion of its length and an enlarged uphole portion adapted to fit in the bottom hole assembly, the housing enclosing the shaft, the turbine, and the pump; and thrust bearing means located within the enlarged uphole portion of the housing to support the shaft axially.

30. The turbine pump of claim 29, in which the bottom hole assembly is at the end of a pressurized power fluid line in a well, the turbine pump additionally comprising means for coupling the pressurized power fluid line to the thrust bearing means located within the enlarged uphole portion of the housing for lubricating the thrust bearing means.

31. The turbine pump of claim 29, in which the thrust bearing means comprises:

a cylindrical cavity within the uphole portion of the housing;

a cylindrical thrust collar disposed in the cavity and attached to the shaft;

first and second small clearances formed between the ends of the thrust collar and the ends of the cavity, the clearances increasing and decreasing in complementary fashion responsive to axial movement of the shaft;

first and second annular grooves formed in the enlarged uphole portion adjacent to and communicating with the ends of the cavity;

first and second annular passages surrounding the shaft adjacent to the ends of the cavity and in communication with the first and second clearances, respectively;

a first source of fluid at a first pressure;

first and second conduits connecting the first source to the first and second annular grooves, respectively;

first and second restrictions having fixed cross sections in the first and second conduits, respectively; and a second source of fluid at a second pressure lower than the first pressure, the second source being connected to the first and second annular passages such that the pressure in the first and second annular grooves changes in inverse relationship to the first and second clearances, respectively, responsive to axial movement of the shaft.

32. The turbine pump of claim 31, in which the thrust collar has an annular groove around its side and the second source is connected to the annular groove of the thrust collar.

33. The turbine pump of claim 32, in which the thrust bearing additionally comprises:

a dummy thrust collar attached to the end of the shaft enclosed by the enlarged uphole portion of the housing, the dummy thrust collar having a first end surface adjacent to the end surface of the shaft, and a second end surface opposite the first end surface;

means for coupling the first source to the end surface of the shaft and the first end surface of the dummy thrust collar to apply a compressive force to the shaft; and means for coupling the second source to the second end surface of the dummy thrust collar to apply a tensile force to the shaft, the dummy thrust collar being sized so the compressive force approximately balances the tensile force and force exerted on the shaft by the turbine and the pump.

34. The turbine pump of claim 33, in which the turbine and the pump each comprise a plurality of sets of one or more rotatable blades and a plurality of sets of one or more stationary blades mounted about the shaft in adjacent alternating relationship, the rotatable blades being attached to the shaft and the stationary blades being attached to the housing, the turbine pump additionally comprising:

an inlet at the bottom hole end of the sets of blades of the pump for introduction from the well of production fluid flowing therethrough axially of the shaft;

an outlet at the uphole end of the sets of blades of the pump for removal of pressurized production fluid flowing therethrough axially of the shaft;

an inlet at the bottom hole end of the sets of blades of the turbine for introduction of pressurized power fluid flowing therethrough axially of the shaft, the first source being the turbine inlet; and an outlet at the uphole end of the sets of blades of the turbine for removal of spent power fluid flowing therethrough axially of the shaft, the second source being the turbine outlet.

35. The turbine pump of claim 31, in which the thrust bearing additionally comprises:

a dummy thrust collar attached to the end of the shaft enclosed by the enlarged uphole portion of the housing, the dummy thrust collar having a first end surface adjacent to the end surface of the shaft, and a second end surface opposite the first end surface;

means for coupling the first source to the end surface of the shaft and the first end surface of the dummy thrust collar to apply a compressive force to the shaft; and means for coupling the second source to the second end surface of the dummy thrust collar to apply a tensile force to the shaft, the dummy thrust collar being sized so the compressive force approximately balances the tensile force and force exerted on the shaft by the turbine and the pump.

36. A system for pressurizing fluid in a well comprising:

a bottom hole assembly disposed in a well, the bottom hole assembly having an axially elongated cavity defined by a side wall and a lubricant supply groove formed in the side wall along the length of the cavity;

a free axially elongated housing adapted to fit snugly in the cavity of the bottom hole assembly against the side wall;

an axially elongated axial flow turbine enclosed in the housing;

an axially elongated axial flow pump enclosed in the housing;

a shaft in the housing coupling the turbine to the pump;

a plurality of journal bearings in the housing supporting the shaft at different points along its length;

a groove network formed in the housing, the groove network extending around the housing to intersect the lubricant supply groove formed in the side wall of the cavity;

a passage leading from the groove network to each journal bearing at each point along the length where a journal bearing supports the shaft; and a source of lubricant under pressure connected to the lubricant supply groove formed in the side wall of the cavity.

37. The system of claim 36, in which the lubricant supply groove comprises a spiral groove formed in the side wall of the cavity and the groove network comprises an annular groove formed around the housing at each point along the length where a journal bearing supports the shaft.

* * * * *